US010807266B2

(12) United States Patent
Mueller

(10) Patent No.: US 10,807,266 B2
(45) Date of Patent: Oct. 20, 2020

(54) SLICER FEED UNIT

(71) Applicant: MULTIVAC SEPP HAGGENMÜLLER SE & CO. KG, Wolfertschwenden (DE)

(72) Inventor: Ralf Peter Mueller, Kempten (DE)

(73) Assignee: MULTIVAC SEPP HAGGENMÜLLER SE & CO. KG, Wolfertschwenden (DE)

( * ) Notice: Subject to any disclaimer, the term of this patent is extended or adjusted under 35 U.S.C. 154(b) by 1166 days.

(21) Appl. No.: 14/705,666

(22) Filed: May 6, 2015

(65) Prior Publication Data

US 2015/0321371 A1 Nov. 12, 2015

(30) Foreign Application Priority Data

May 7, 2014 (DE) ..... 10 2014 106 353

(51) Int. Cl.

| | |
|---|---|
| ***B26D 3/16*** | (2006.01) |
| ***B26D 7/01*** | (2006.01) |
| ***B26D 7/06*** | (2006.01) |

(52) U.S. Cl.

CPC ..... *B26D 7/0616* (2013.01); *B26D 3/161* (2013.01); *B26D 7/01* (2013.01); *B26D 7/0633* (2013.01);

(Continued)

(58) Field of Classification Search

CPC ..... B26D 3/161; B26D 7/01; B26D 7/0616; B26D 7/0683; B26D 2007/011; B26D 7/0608; B26D 7/0625; B26D 7/0633; B26D 2210/02; Y10T 83/4632; Y10T 83/4635; Y10T 83/654; Y10T 83/6657;

(Continued)

(56) References Cited

U.S. PATENT DOCUMENTS

| | | | |
|---|---|---|---|
| 1,251,525 | A | 1/1918 | Hopkinson |
| 1,451,776 | A | 4/1923 | Jaquette |

(Continued)

FOREIGN PATENT DOCUMENTS

| | | | |
|---|---|---|---|
| CA | 2225776 | A1 | 6/1998 |
| DE | 645494 | C | 5/1937 |

(Continued)

OTHER PUBLICATIONS

Search Report of GB patent office (GB-IPO) dated Dec. 10, 2015, from counterpart family Application No. GB1507961.9 (in English).

(Continued)

*Primary Examiner* — Clark F Dexter
(74) *Attorney, Agent, or Firm* — Husch Blackwell LLP

(57) ABSTRACT

Slicers for cutting food such as sausage, cheese or meat, for example, into slices. Such slicers, and processes related thereto, may simultaneously slice at least two stick-shaped pieces of food by a cutting blade. The feeding of the food that is sliced may be further improved thereby. An exemplary feed unit (9) for feeding food (10) to a cutting blade (7) includes at least one gripper carriage (20) including a gripper receiving beam (22) and at least one movable gripper (21). This gripper (21) may be operated by a stationary drive, and the mechanical work for seizing can be transferred to the grippers (21) via guides or further drive structure.

20 Claims, 7 Drawing Sheets

(52) U.S. Cl.
CPC ..... *B26D 7/0683* (2013.01); *B26D 2007/011* (2013.01); *Y10S 83/932* (2013.01); *Y10T 83/4632* (2015.04); *Y10T 83/4635* (2015.04); *Y10T 83/654* (2015.04); *Y10T 83/666* (2015.04); *Y10T 83/6657* (2015.04); *Y10T 83/6662* (2015.04); *Y10T 83/6664* (2015.04)

(58) Field of Classification Search
CPC ..... Y10T 83/6659; Y10T 83/666; Y10T 83/6662; Y10T 83/6664
USPC ..... 83/277, 278, 409, 437.2, 437.3, 437.4, 83/437.5, 437.6, 932
See application file for complete search history.

(56) References Cited

U.S. PATENT DOCUMENTS

| | | | | |
|---|---|---|---|---|
| 2,780,258 | A * | 2/1957 | Folk | B26D 7/01 269/153 |
| 4,130,193 | A | 12/1978 | Bourgeois | |
| 4,583,435 | A | 4/1986 | Fessler | |
| 4,644,729 | A | 2/1987 | Fessler | |
| 5,125,305 | A | 6/1992 | Morrison et al. | |
| 5,628,237 | A | 5/1997 | Lindee et al. | |
| 5,775,190 | A | 7/1998 | Terai | |
| 6,935,215 | B2 | 8/2005 | Lindee et al. | |
| 7,832,316 | B2 | 11/2010 | Weber | |
| 7,856,913 | B2 | 12/2010 | Matzunsky et al. | |
| 2004/0035276 | A1 | 2/2004 | Weber | |
| 2004/0055439 | A1 * | 3/2004 | Lindee et al. | B26D 7/0683 83/647 |
| 2006/0162517 | A1 | 7/2006 | Perini | |
| 2007/0214969 | A1 | 9/2007 | Mueller et al. | |
| 2009/0120256 | A1 | 5/2009 | Pasek | |

FOREIGN PATENT DOCUMENTS

| | | | |
|---|---|---|---|
| DE | 3010732 | A1 | 10/1981 |
| DE | 3631922 | A1 | 3/1988 |
| DE | 19518583 | A1 | 11/1996 |
| DE | 19525742 | A1 | 1/1997 |
| DE | 10001338 | A1 | 8/2001 |
| DE | 102008020293 | A1 | 10/2009 |
| DE | 202009017954 | U1 | 9/2010 |
| DE | 102010019744 | A1 | 11/2011 |
| DE | 202013101903 | U1 | 5/2013 |
| EP | 0547389 | A1 | 6/1993 |
| EP | 0713753 | B1 | 5/2000 |
| EP | 0867263 | B1 | 11/2002 |
| EP | 0930137 | B1 | 8/2005 |
| EP | 1582318 | B1 | 8/2006 |
| EP | 2543484 | A1 | 1/2013 |
| EP | 2543485 | A1 | 1/2013 |
| FR | 2677573 | A1 | 12/1992 |
| GB | 20646 | A | 7/1912 |
| GB | 2234892 | A | 2/1991 |
| GB | 2386317 | A | 9/2003 |
| GB | 2446565 | A | 8/2008 |
| JP | 2000-288983 | A | 10/2000 |
| WO | 02/30635 | A1 | 4/2002 |
| WO | 2005/037501 | A2 | 4/2005 |
| WO | 20051037501 | A3 | 4/2005 |

OTHER PUBLICATIONS

Copending commonly-owned U.S. Appl. No. 14/950,159, filed Nov. 24, 2015, currently under examination.

* cited by examiner

SLICER FEED UNIT

This application claims benefit of priority to prior German national application no. DE102014106353.8 filed on May 7, 2014, and the entirety of this German application no. DE102014106353.8 is expressly incorporated herein by reference in its entirety and as to all its parts, for all intents and purposes, as if identically set forth in full herein.

TECHNICAL FIELD

The present disclosure relates to slicers for cutting food, such as sausage, cheese or meat, for example, into slices, in particular for simultaneously slicing at least two stick-shaped pieces of food via a cutting blade.

BACKGROUND

Stick-shaped food is cut into slices or is sliced, respectively, via powerful cutting machines, also called slicers, wherein at least one food stick is fed to a cutting blade.

EP0713753B1, for instance, shows a quick cutting machine comprising a cutting station and a drive, which drives the knife along a predetermined cutting path, a device for supporting the food sticks, which are to be cut, wherein each of the food sticks can be fed by means of its own feed drive in response to simultaneously feeding two food sticks. The feed drives move the food sticks along the parallel feed paths vertically to the cutting path of the knife, wherein knife and feed are placed at an angle to the table plane of the cutting machine. The food sticks are inserted into the cutting machine horizontally and are lifted at an angle by grippers upstream of the cutting station at the end, which is located at a distance from the cutting station, for a cutting position.

According to EP2543484A1, the gripper or product holder is provided with a guide device, which guides the product holder on two sides, which are vertically spaced apart from the conveying direction. According to EP 2543485 A1, the guide device encompasses at least one carriage, which can be moved along the conveying direction, on which the product holder is arranged. For this purpose, the carriage is coupled to a linear drive, in particular an electromagnetic linear motor.

At least one actuator of the linear drive is furthermore coupled to the carriage in a contact-free manner and is guided in a cylindrical hollow space of the guide device along the conveying direction. Carriage and/or actuator consist of magnetizable material. The actuator divides the hollow space into sections, on at least one of which a hydraulic fluid can act, so as to move the actuator. The encapsulation, analogous to ball screws, which are also used, can be problematic hereby.

Further problems or application limits may result from the limited length and speed in the case of ball screws in response to a quick return stroke.

WO02/30635A1 discloses a device for simultaneously slicing at least two food products, in the case of which a slicing of slices of the same thickness as well as a slicing of portions comprising a uniform weight is to be attainable in spite of product differences, which are at hand. For this purpose, the product holders encompass a common base drive for moving synchronously, wherein an additional movement can be superimposed positively or negatively in the case of at least one product holder. This is attained by means of an auxiliary drive. An additional lifting of the product for changing the slice thickness is created by means of the auxiliary drive, if this is necessary based on the determined stack weights.

Another device of this type for slicing food follows from WO02/30635A1, in the case of which food sticks are transported to the blade on a conveying means. The rear ends of the food sticks are at least temporarily in contact with a means, for example a gripper, which does not have its own drive during the contact. This is to ensure that the food sticks are tensioned sufficiently firmly on the conveying means to the end and thus stay sliceable.

SUMMARY

The present disclosure relates to the task of developing slicers for cutting food, such as sausage, cheese or meat, for example, into slices, in particular for simultaneously slicing at least two stick-shaped pieces of food, which slicers may be provided with a further improved feed of the food that is to be sliced.

Such cutting machines, slicers, may include a lifting and conveying device for the food that is to be sliced, to the cutting blade; a feed unit for the food that is to be sliced; a stacking table for the food, that was sliced; as well as a control unit.

According to the present disclosure, an exemplary feed unit encompasses at least one gripper carriage including a gripper receiving beam, on which at least one or any number of grippers are guided. The feed unit furthermore includes a linear guide, which is embodied via guide bars, e.g., on which the gripper carriage is arranged; furthermore a servo drive operatively connected for moving the gripper carriage. The gripper or the grippers are operated by a stationary drive, wherein the mechanical work of gripping is transferred via the guide bars or further drive structure.

A significant feature of exemplary slicers according to the present disclosure is that the drive for operating the grippers does not move along on the gripper carriage, but is accommodated in the machine housing in a stationary manner and may thus be implemented electrically as well as pneumatically. Otherwise, in the alternative of moving along on the gripper carriage, an unhygienic and interference-prone movable energy chain would be necessary.

Advantageous further developments are disclosed within the present disclosure, the totality of which includes the appended drawings and claims.

In an exemplary version, the gripper carriage is thus guided on the guide bars, and is arranged so as to be linearly movable, wherein at least one guide bar may be rotated simultaneously about its own longitudinal axis.

A gripper receiving beam of the gripper carriage is guided, in particular, on the other guide bar and may be moved along the feed axis of the food by means of a toothed belt overdrive. The toothed belt overdrive includes two wheels, between which a toothed belt runs back and forth, wherein the toothed belt is simultaneously coupled to the gripper carriage, so that the gripper carriage is entrained in response to a movement of the toothed belt.

From the aforegoing description, readers shall immediately understand that there is contemplated at least one gripper carriage and at least one belt. However, this should be understood in a non-limiting sense, as readers shall also understand that provision may also possibly be made for two independent gripper carriages, that each include a toothed belt.

Preferably, the gripper receiving beam may be arranged vertically spaced relative to the feed axis of the food and may be provided with a linear element guided therein. A push rod, the other end of which is articulated in a rotationally movable manner on the guide bar, is arranged on the end of the linear element, that is located closer to the guide bar.

A transverse movement of the linear element relative to the feed axis takes place by rotation of the guide bar. The linear element forms the interface for transferring the drive work to the grippers. The grippers may be removed for cleaning purposes and may be fastened securely to the gripper receiving beam via a quick fastener. The transfer of the drive force for the gripping movement is to also be ensured thereby. In a preferred version, camming pockets, which then transfer the force to the lever kinematics of the gripper in a positive manner, are incorporated into the linear element. In the case of this interface, the transfer of the drive force from the sides of the pockets to a roller (follower) located on a pivot lever, has proven to be particularly advantageous, because of low friction. The reverse arrangement of a roller on the linear element and an entraining/cam surface on a pivot lever or a link piece is also efficient.

The force for operating the claws is preferably transferred via a slider crank by the pivot lever located on the gripper. Instead of the pivot lever, a slide gate or similar mechanical elements are also possible, which divert the operating force in the axial direction of the gripper. The operation of the individual claws takes place analogously to the existing, for example pneumatically operated, grippers via levers, cranks, or tooth segment toothed rack combinations.

An exemplary toothed belt overdrive according to the present disclosure includes a drive wheel and a tensioning roller, between which a toothed belt runs back and forth. Both ends of the toothed belt are connected to gripper carriage. This allows for the use of open toothed belt. When using a continuous belt (loop), the connection to the gripper carriage may be made in the same manner.

The toothed belt may preferably be a belt including steel cords that are embedded in an elastic base belt body of an elastomer material that is suitable for use in food.

An exemplary slicer according to the present disclosure is characterized by a high measure of hygiene and longevity of the product feed.

BRIEF DESCRIPTION OF THE DRAWINGS

More details are explained in the following discussion via an exemplary version depicted in the appended drawing sheets. In the drawings.

DETAILED DESCRIPTION

Any reference in this specification via terminology such as "one version," "a version," "a variant," "one variant," "one embodiment," and "an embodiment," should be understood to mean that a particular feature, structure, or characteristic described in connection with the version, variant, or embodiment is included in at least one such version, variant, or embodiment of the disclosure. The appearances of phrases "in one/a version," "in one/a variant," "in one/a embodiment", and the like in various places in the specification are not necessarily all referring to the same variant, version, or embodiment, nor are separate or alternative versions, variants or embodiments necessarily mutually exclusive of other possible versions, variants, or embodiments. Moreover, various features are described which may be exhibited by some versions, variants, or embodiments and not by others. Similarly, various requirements are described, and some may be requirements for some versions, variants, or embodiments but not others. Furthermore, if the specification states a component or feature "may", "can", "could", or "might" be included or have a characteristic, via such terminology it should be understood that such particular component or feature is not always necessarily required to be included or have the characteristic. Additionally, as used throughout this specification, the terms 'a', 'an', 'at least' do not denote a limitation of quantity, but rather denote the presence of at least one of the referenced item, and any usage of the term 'a plurality' denotes the presence of more than one referenced items.

Figure 1:
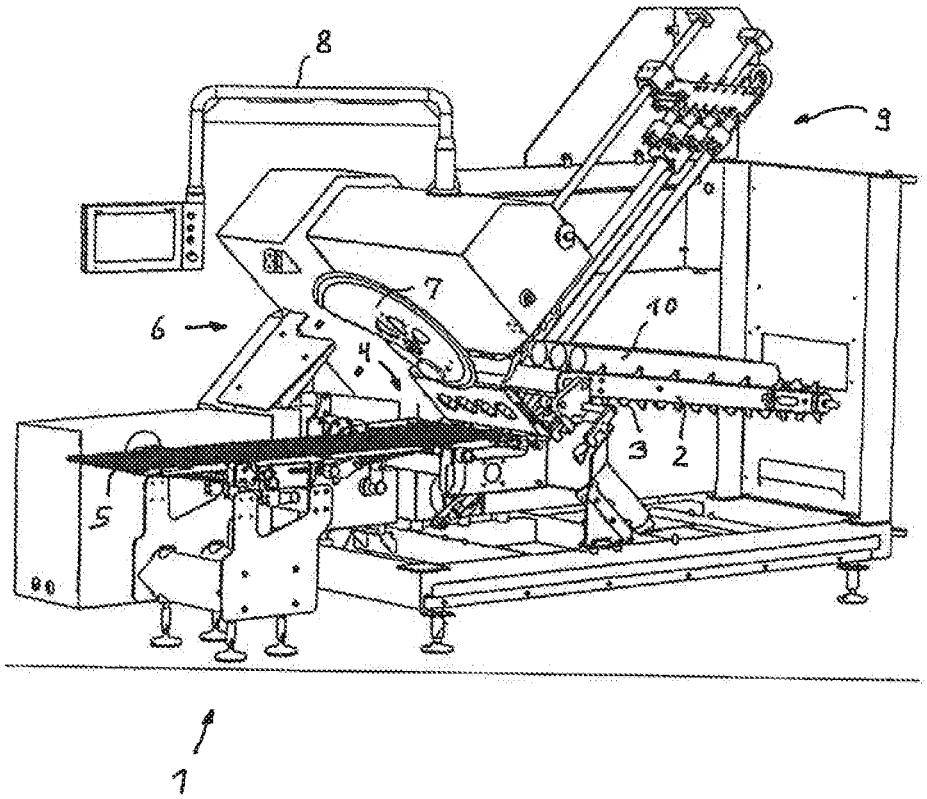
FIG. 1—depicts a version of an exemplary slicer according to the present disclosure.

A slice cutting machine, as in exemplary FIG. 1, for slicing stick-shaped food 10 into slices, a so-called slicer 1 for the food 10 that is to be cut, e.g. sausage or cheese in the form or sticks or bars, includes a cutting device 6 including a cutting blade 7, a lifting and conveying device 2, a stacking table 4 for the sliced food (portions) as well as a conveyor belt 5 for removing the sliced food 10 to a non-illustrated vacuum packaging device.

It furthermore includes a control unit 8 for the slicer 1, and a feed unit 9 for the food 10 that is to be sliced.

The cutting blade 7 (FIG. 6) may be fixed in the cutting device 6 by screws or quick-clamp device on an accommodation of a rotor 13 that is connected to a drive motor. A feed plane for feeding the food 10 that is to be cut, to which the conveyor belt 5 for removing stacks of slices of the cut food 10 to the stacking table 4 connects below this feed plane, is assigned to the cutting blade 7.

The cutting device 6 and the cutting blade 7 are arranged so as to be inclined in the direction of the stacking table 4, which provides for an improved cutting line and which saves space or which allows for longer food sticks in the slicer 1, respectively.

The drive motor sets the cutting blade 7 into rotation about the axis of the rotor 13. For making the cut, the block or stick-shaped food 10 is fed to the cutting blade 7 with an infeed that corresponds to the desired slice thickness.

The cutting blade 7 is in particular a sickle blade, as it is disclosed in DE202013101903U1, for example. On the circumference, it is provided with a spiraled cutting edge 12, that points radially outwards and which encompasses a recess. It is furthermore provided with a centrical accommodating hole 11 and may thus be directly and releasably assembled on the cutting rotor 13.

The cutting blade 7 is embodied with the cutting edge 12, that points outwards in an at least partially ring-shaped manner, with the recess and with a radius expansion of the cutting edge 12, wherein the center of area is located outside of the axis of rotation, which does not require a separate positioning of the axis of rotation and blade, for carrying out a cut.

The cutting blade 7 encompasses an accommodating hole 11 including a diameter of approx. 100 mm, that is surrounded by two spaced-apart partial circles including a larger diameter.

Fastening holes on the inner partial circle serve to releasably fasten the cutting blade 7 to the accommodation of the rotor 13.

Figure 6:
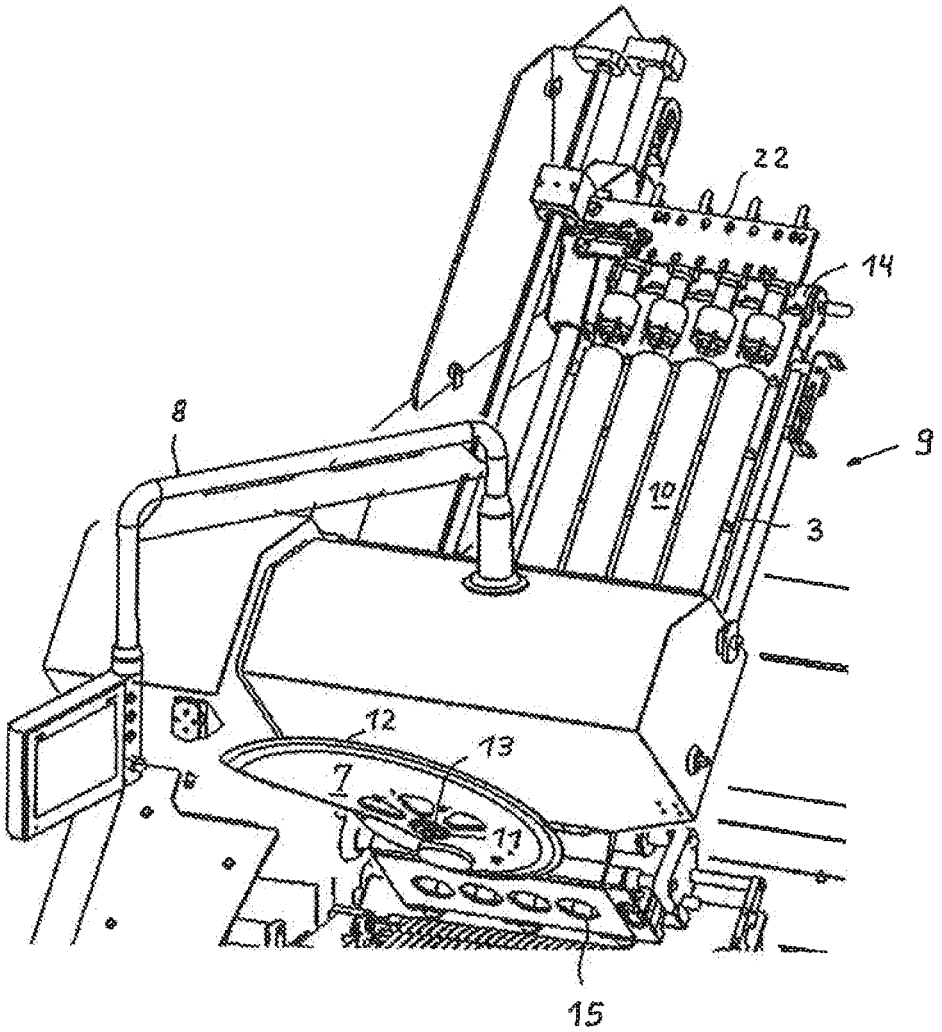
FIG. 6—depicts the slicer according to FIG. 1 in magnified partial view; and, FIG. 7—depicts a toothed belt in cross-section.

From an assembly area, the stick-shaped food 10 reaches to a continuous conveyor belt 14 of the lifting and conveying device 2, that is provided with accommodating profiles 3 (FIGS. 1, 6). The accommodating profiles 3 encompass a mating contour to the food stick and ensure a parallel feeding of the food sticks and thus the same cutting parameters of the food sticks fed in one clamping.

The food 10 may be lifted to approximately the height of the cutting blade 7 by the lifting and conveying device 2 and is subsequently guided through openings 15, that fit the shape, in an intermediate wall.

The ends of the food 10, that face away from the cutting blade 7, are additionally pivoted upwards about a virtual pivot point, in common with the cutting blade 7, until the ends are lifted up and their longitudinal axes, respectively, form approximately a right angle to the cutting plane of the cutting blade 7.

Figure 3:
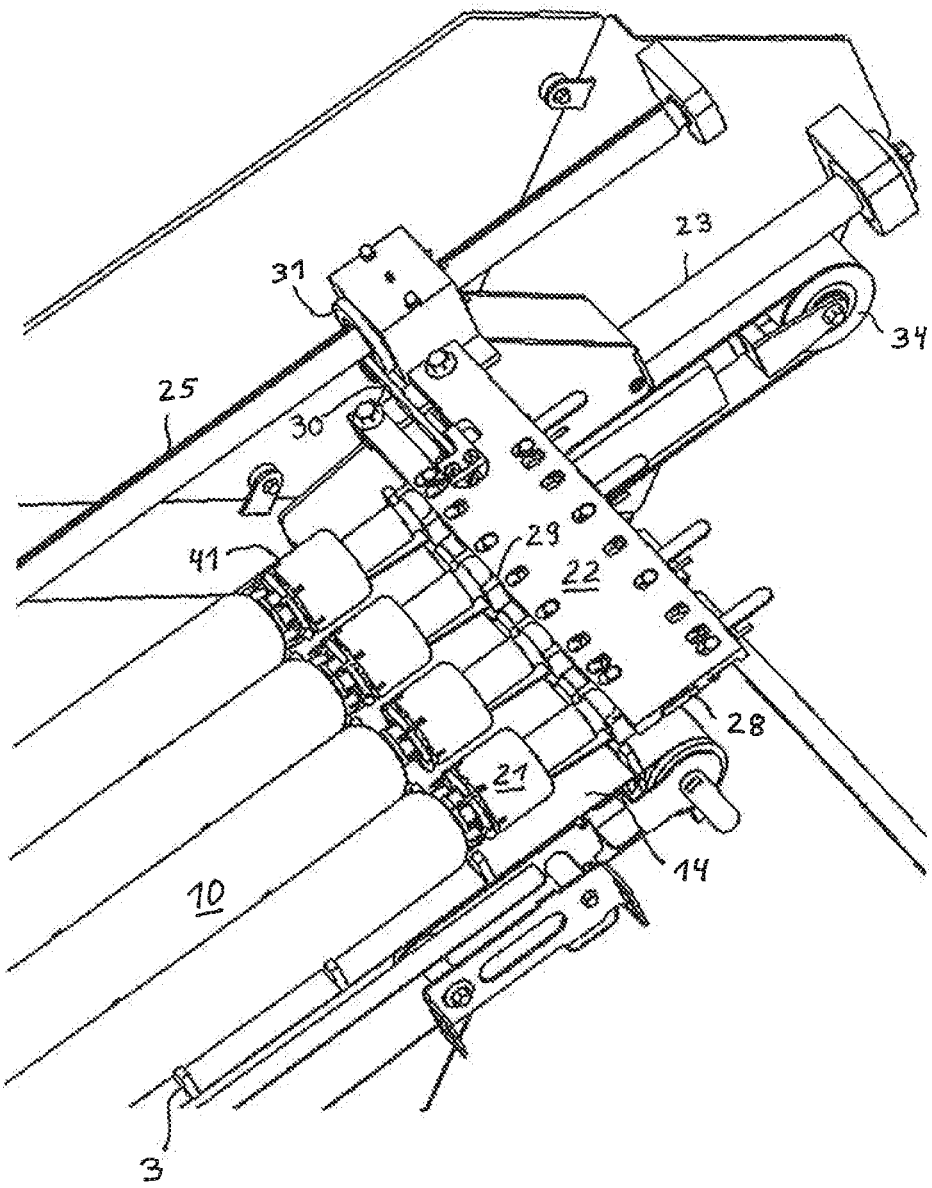
FIG. 3—depicts a gripper accommodation of the feed unit according to FIG. 2.
Figure 4A:
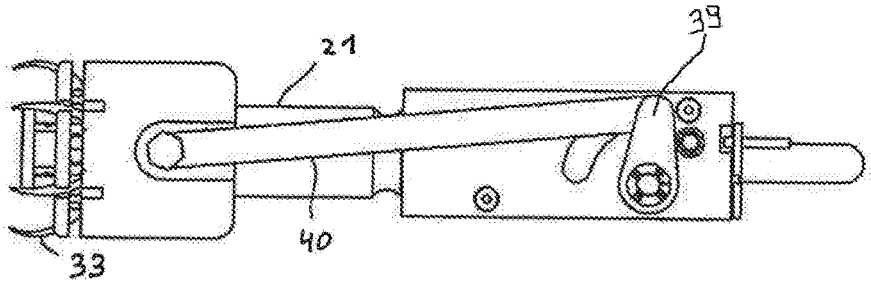
FIG. 4A—depicts an exemplary gripper according to the present disclosure, with gripper claw open.
Figure 4B:
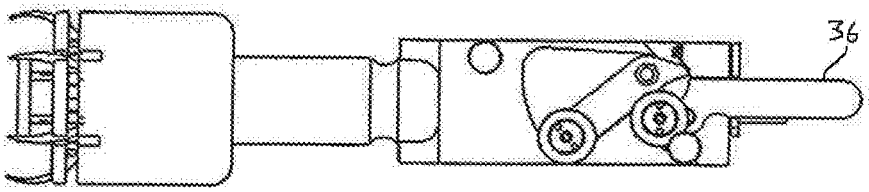
FIG. 4B—depicts the exemplary gripper of FIG. 4A from its opposite side that engages a gripper receiving beam.
Figure 4C:
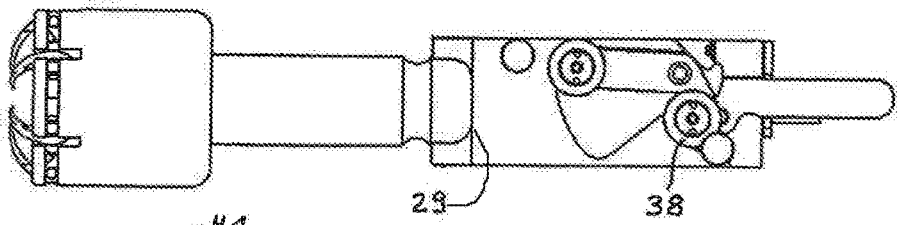
FIG. 4C—depicts the exemplary gripper of FIG. 4D from its opposite side that engages a gripper receiving beam.
Figure 4D:
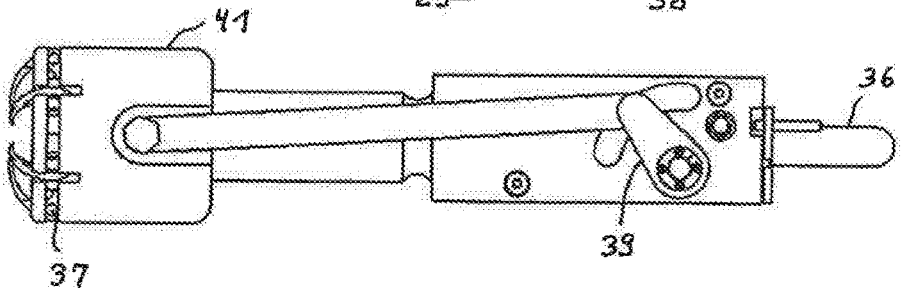
FIG. 4D—depicts an exemplary gripper similar to the view of FIG. 4A but with the gripper claw closed.
Figure 5:
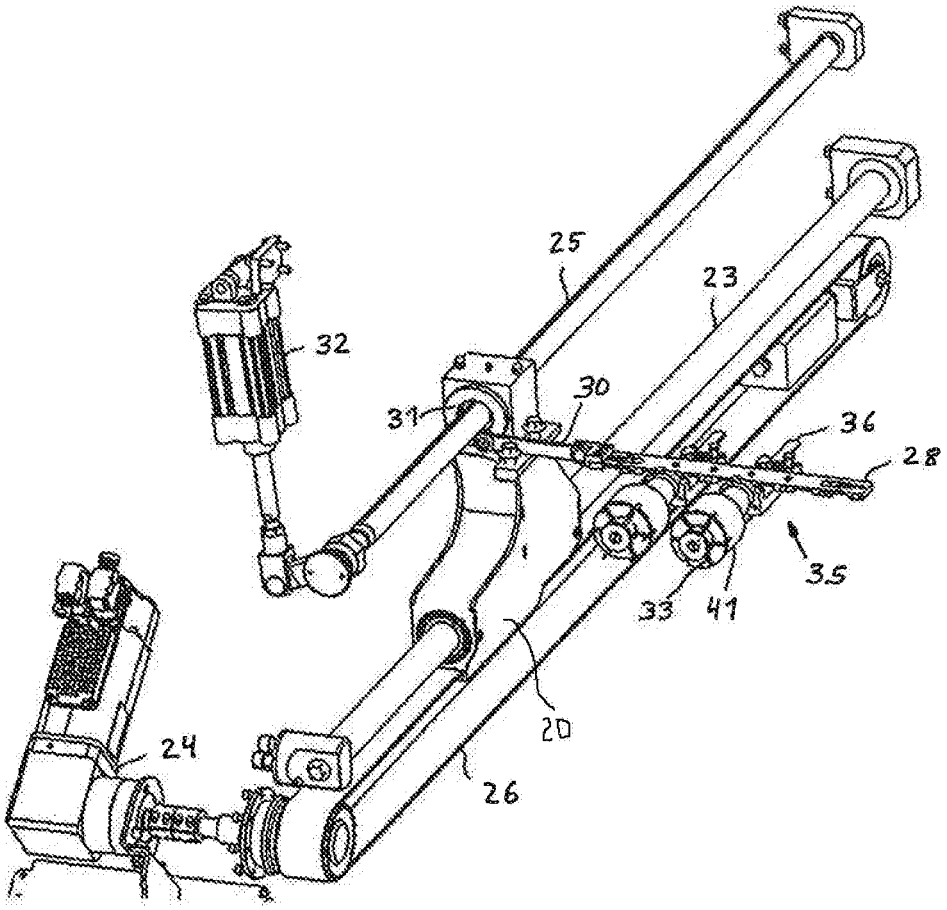
FIG. 5—depicts the gripper accommodation according to FIGS. 2, 3 in a different illustration with the gripper receiving beam removed.

This makes it possible for product holders or grippers 21 of the feed unit 9 to seize the remote ends of the food sticks 10 and to ensure an even feeding to the cutting device 6 in longitudinal direction (FIG. 3).

Figure 2:
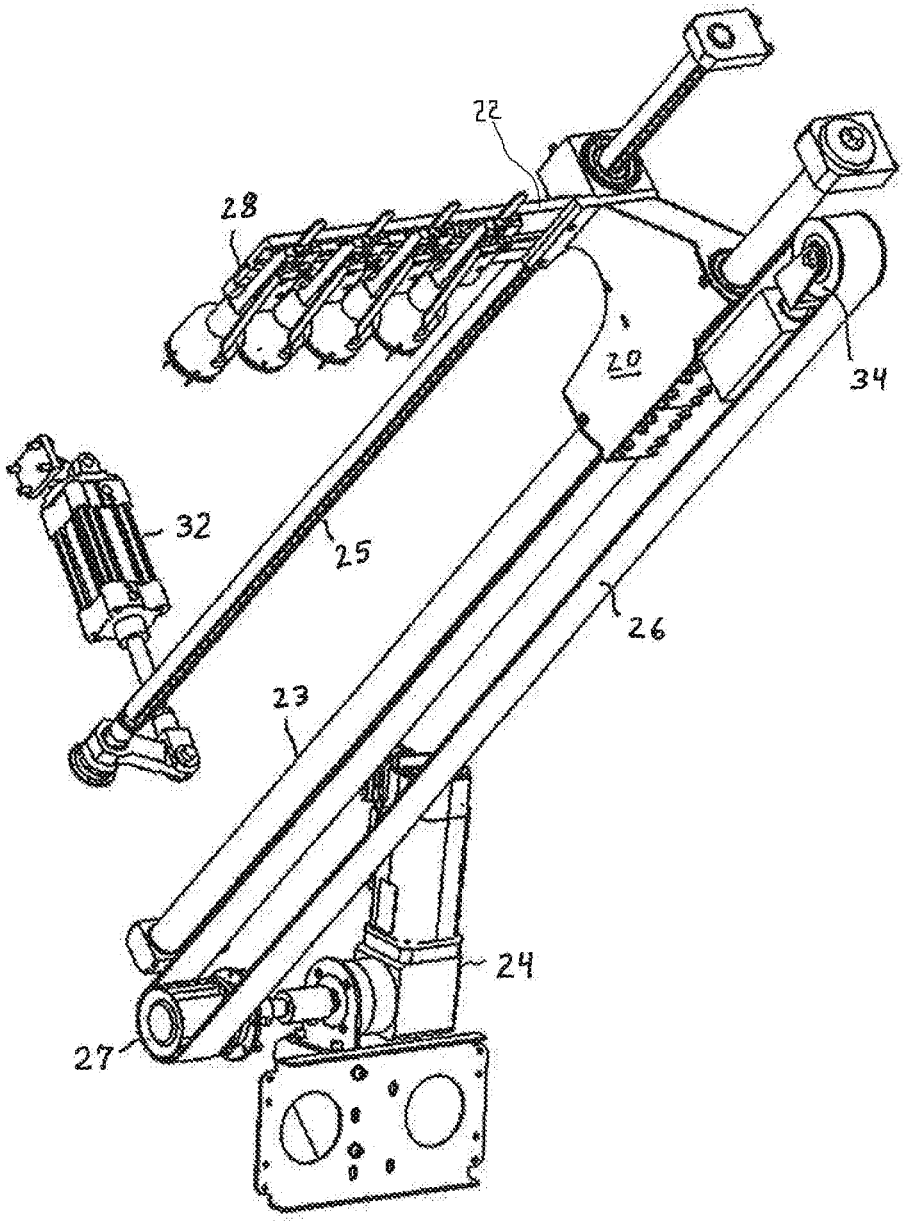
FIG. 2—depicts a feed unit of the slicer according to FIG. 1.

The feed unit 9 furthermore includes a gripper carriage 20 including a gripper receiving beam 22, on which the grippers 21 are guided, two guide bars 23 and 25, which are arranged parallel to one another, a servo drive 24 and elements for moving the gripper carriage 20 (FIGS. 2, 3). The gripper carriage 20 is guided on the guide bars 23 and 25 so as to be linearly movable, wherein the guide bar 25 can simultaneously also carry out a rotation about its own longitudinal axis.

The gripper carriage 20 (FIG. 2) is guided with the gripper receiving beam 22 on/at the guide bar 23, which is round in the example, and is moved precisely along the feed axis by means of a toothed belt overdrive via the servo drive 24.

The toothed belt overdrive includes a drive wheel 27 including teeth and a tensioning roller 34, that may also be embodied without toothing, between which a toothed belt 26 runs back and forth. As depicted, the toothed belt 26 is coupled to the gripper carriage 20 under the guide bar 23 (FIG. 2). This coupling allows for the use of open toothed belts, which are also identified as material or goods sold by the meter/length.

Figure 7:
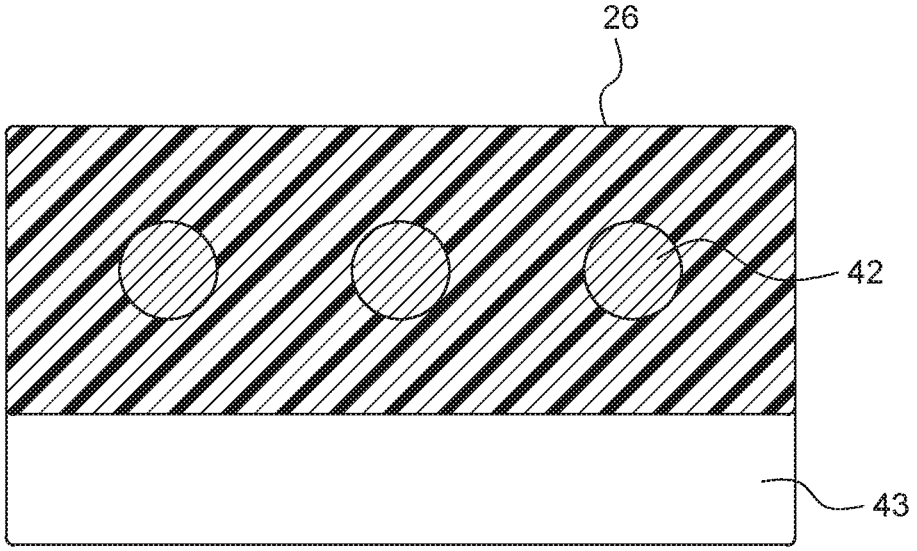

FIG. 7 shows a conventional reinforced belt construction that includes a toothed belt 26, which includes teeth 43, preferably includes including steel cords 42, wherein the steel cords 42 that are embedded into an elastic basic belt body of an elastomer material suitable for use in food. According to a special version, the steel pull cords 42 are sealed completely with the belt material, which applies for the belt sides as well as for the tooth 43 bases. The use of the toothed belt 26 is very hygienic because these cords/strands 42, into which water and dirt could permeate, are sealed completely with plastic. In addition, such a toothed belt 26 is very durable because corrosion of the strands 42 does not occur and the realizable feed movement is constant and highly accurate due to the high stiffness of the steel strands.

Due to manufacturing, the pull cords in the case of common/conventional toothed belts are, in contrast, exposed on the belt sides as well as in the tooth 43 base, where they rest on the grooves when being sealed.

The stiffness, which may be lower in comparison to conventional toothed belts including steel strands, may be compensated by the corresponding dimensioning of the toothed belt 26 as regards to width and partition.

The grippers 21 may be coupled to the gripper receiving beam 22 of the gripper carriage 20 via a quick fastener 35, so that they may be operated centrally from the stationary part of the slicer 1. They can be controlled accurately via a common mechanism.

The coupling of each respective gripper 21 onto the gripper receiving beam 22 takes place via respective recesses 29 and via a respective locking lever 36. As depicted in FIG. 3, the gripper receiving beam 22 is arranged vertically spaced relative to the feed axis of the food 10 and is provided with a linear element (also referred to as a linear gripper actuating member) 28 guided therein. For controlled reciprocation, as depicted a push rod 30 is arranged in a rotatably movable manner on the end of the linear element 28 located closer to the guide bar 25. The other end of the push rod 30 is articulated on a rotationally-fixed ring 31 of the guide bar 25 in a rotatably movable manner. A triggered/initiated rotation or a torque of the guide bar 25, triggered by a servo motor 32, is thus converted into a linear movement of the linear element 28.

This linear movement is transferred to all of the coupled grippers 32 similarly and simultaneously, via interfaces, and controls the gripper mechanism for operating the gripper claws 33.

In FIGS. 4A-4D, grippers 21 are illustrated in an exemplary manner with open (FIGS. 4A & 4B) and then closed (FIGS. 4C & 4D) gripper claws 33. The gripper mechanism includes a pivot lever 39, that is arranged on a roller 38 and which is connected to a slider crank 40. The other end of the slider crank 40 corresponds to the movement device of the gripper claws 33.

The pivot lever 39 is pivoted in the direction of a gripper head 41 via linear movement of the linear element 28 for closing the gripper claws 33, and the slider crank 40 thereby pushes the gripper head 41, which is guided in a groove, forwards. The gripper claws 33 are thereby pivoted inwards about their bearing point (cylinder pins 37) in the direction of the longitudinal axis of the food stick and engage therewith.

The slider crank 40 is pulled in the opposite direction via a linear movement of the linear element 28 for opening the gripper claws 33 or for letting go of the food stick, respectively.

As compared to currently common pneumatic drives, the design is simplified significantly, and is cost-efficient. Common plug-in connections, the tangle of pneumatic hoses, as well as a grease lubrication of the pneumatic cylinders are no longer necessary. This also serves for an improved hygiene.

Choice of a purely electrical drive of the slicer 1 according to the present disclosure makes it possible to operate without compressed air.

In closing, it should be noted that the above description is intended to illustrate rather than limit the invention, and that readers skilled in the technological art shall be capable of designing alternative embodiments without departing from the protected scope of invention as set forth by the appended claims. As equivalent elements can be substituted for elements employed in claimed invention so as to obtain substantially the same results in substantially the same way, the protected scope of the present invention is defined by the appended claims, including known equivalents and unforeseeable equivalents at the time of filing of this application. Furthermore, in the claims, the verb 'comprise' and its conjugations do not exclude the presence of elements or steps other than those listed in any claim or the specification as a whole. The singular reference of an element does not necessarily exclude the plural reference of such elements and vice-versa. The mere fact that certain measures are recited in mutually different dependent claims does not necessarily indicate that a combination of these measures cannot be used to advantage.

LIST OF REFERENCE LABELS

1 slicer
2 lifting and conveying device
3 accommodating profile
4 stacking table
5 conveyor belt
6 cutting device
7 cutting blade
8 control unit
9 feed unit
10 food
11 accommodating hole
12 cutting edge
13 rotor
14 continuous conveyor belt
15 opening
20 gripper carriage
21 gripper
22 gripper receiving beam
23 guide bar
24 servo drive
25 guide bar
26 toothed belt
27 toothed wheel
28 linear element/member
29 recess
30 push rod
31 ring
32 servo motor
33 gripper claw
34 tensioning or deflection roller
35 quick fastener
36 locking lever
37 cylinder pin
38 roller
39 pivot lever
40 slider crank
41 gripper head
42 reinforcing cords/strands
43 belt tooth

What is claimed is:

1. A slicer feed unit comprising:

a first guide bar; a gripper carriage mounted for controlled reciprocation along at least a portion of said first guide bar, said gripper carriage being guided by said first guide bar;

a second guide bar that guides said gripper carriage in controlled reciprocation along at least a portion of said second guide bar, said second guide bar having an axis and being rotatable about said axis;

a guide bar motor being operatively connected to said second guide bar to controllably rotate said second guide bar about its axis;

a gripper receiver mounted on said gripper carriage, said gripper receiver including a linear gripper actuating member that is controllably reciprocatable transversely relative to the second guide bar's axis;

said linear gripper actuating member having a proximal end, said proximal end being operatively connected to a mechanical linkage, wherein said mechanical linkage is operably connected to said second guide bar such that rotation of said second guide bar about its axis by action of said guide bar motor causes the transverse reciprocation of said linear gripper actuating member.

2. A slicer feed unit as claimed in claim 1 further comprising:

a belt drive arrangement that controllably drives said gripper carriage in reciprocation along at least a portion of said first guide bar and along at least a portion of said second guide bar; and said belt drive arrangement including a toothed belt operatively connected to said gripper carriage.

3. A slicer feed unit as claimed in claim 2, said belt drive arrangement further comprising:

a toothed wheel that engages said toothed belt; and a tensioning roller that operatively supports said toothed belt for tensioning said toothed belt.

4. A slicer feed unit as claimed in claim 2 further comprising: said toothed belt comprising a plurality of reinforcing cords sealed within said toothed belt, and said toothed belt comprises an elastic belt body of an elastomer material and the elastomer material is suitable for use with food products.

5. A slicer feed unit as claimed in claim 1 further comprising: said mechanical linkage including a ring engaging said second guide bar to rotate with said second guide bar; and said mechanical linkage including an articulated push rod, said push rod having a respective proximal end coupled to said ring, and said push rod having a distal end coupled to said linear gripper actuating member's proximal end.

6. A slicer feed unit as claimed in claim 1 further comprising:

at least one gripper mounted on said gripper receiver, said linear gripper actuating member engaging said at least one gripper to actuate, by the transverse reciprocation of said linear gripper actuating member, said at least one gripper.

7. A slicer feed unit as claimed in claim 6, wherein said at least one gripper further comprises-a plurality of grippers mounted on said gripper receiver.

8. A slicer feed unit as claimed in claim 6, said at least one gripper further comprising:

a pivot lever, said pivot lever being operatively connected to said linear gripper actuating member to pivot the pivot lever by the transverse reciprocation of said linear gripper actuating member.

9. A slicer feed unit as claimed in claim 8, the at least one gripper further comprising:

a slider crank, said slider crank having a first end operatively connected to said pivot lever; and said slider crank having a second end, said second end being operatively connected to a head of said at least one gripper.

10. A slicer feed unit as claimed in claim 6 further comprising:

a quick connector fastener releasably mounting said at least one gripper on said gripper receiver.

11. A slicer feed unit comprising:

a first guide bar;

a gripper carriage mounted for controlled reciprocation along at least a portion of said first guide bar, said gripper carriage being guided by said first guide bar;

a second guide bar that guides said gripper carriage in controlled reciprocation along at least a portion of said second guide bar, said second guide bar having an axis and being rotatable about said axis;

a ring engaging said second guide bar to rotate with said second guide bar;

a guide bar motor being operatively connected to said second guide bar to controllably rotate said second guide bar about its axis;

a gripper receiver mounted on said gripper carriage, said gripper receiver including a linear gripper actuating member that is controllably reciprocatable transversely relative to the second guide bar's axis, said linear gripper actuating member having a respective proximal end; an articulated push rod, said push rod having a respective proximal end coupled to said ring, said push rod having a distal end coupled to said linear gripper actuating member's respective proximal end to transversely reciprocate said linear gripper actuating member consequent to rotation of said ring and of said second guide bar by action of said guide bar motor; and at least one gripper mounted on said gripper receiver, said linear gripper actuating member engaging said at least one gripper to actuate, by the transverse reciprocation of said linear gripper actuating member, said at least one gripper.

12. A slicer feed unit as claimed in claim 11, wherein said at least one gripper comprises a plurality of grippers mounted on said gripper receiver.

13. A slicer feed unit as claimed in claim 11, the at least one gripper further comprising:

a pivot lever, said pivot lever being operatively connected to said linear gripper actuating member to pivot the pivot lever by the transverse reciprocation of said linear gripper actuating member.

14. A slicer feed unit as claimed in claim 13, the at least one gripper further comprising:

a slider crank, said slider crank having a first end operatively connected to said pivot lever; and said slider crank having a second end, said second end being operatively connected to a head of said at least one gripper.

15. A slicer feed unit as claimed in claim 11 further comprising:

a belt drive arrangement that controllably drives-said gripper carriage in reciprocation along at least a portion of said first guide bar and along at least a portion of said second guide bar; and said belt drive arrangement including a toothed belt operatively connected to said gripper carriage.

16. A slicer feed unit as claimed in claim 15, the belt drive arrangement further comprising:

a toothed wheel that engages said toothed belt; and a tensioning roller that operatively supports said toothed belt for tensioning said toothed belt.

17. A slicer feed unit as claimed in claim 15 further comprising:

said toothed belt comprising a plurality of reinforcing cords sealed within said toothed belt, and said toothed belt comprises an elastic belt body of an elastomer material and the elastomer material is suitable for use with food products.

18. A slicer feed unit as claimed in claim 11 further comprising:

a quick connector fastener releasably mounting said at least one gripper on said gripper receiver.

19. A slicer feed unit comprising:

a first guide bar;

a gripper carriage mounted for controlled reciprocation along at least a portion of said first guide bar, said gripper carriage being guided by said first guide bar;

a toothed belt operatively connected to said gripper carriage to reciprocate said gripper carriage, said toothed belt having reinforcing cords sealed within an elastic belt body of an elastomer material, wherein the elastomer material is suitable for use with food products;

a second guide bar arranged to guide said gripper carriage in controlled reciprocation along at least a portion of said second guide bar, said second guide bar having an axis and being rotatable about said axis;

a guide bar motor being operatively connected to said second guide bar to controllably rotate said second guide bar about its axis;

a gripper receiver mounted on said gripper carriage, said gripper receiver including a linear gripper actuating member that is controllably reciprocatable transversely relative to the second guide bar's axis;

said linear gripper actuating member having a proximal end, said proximal end being operatively connected to a mechanical linkage, and said mechanical linkage operably connected to said second guide bar such that rotation of said second guide bar about its axis by action of said guide bar motor causes the transverse reciprocation of said linear gripper actuating member.

20. A slicer feed unit as claimed in claim 19 further comprising: said mechanical linkage including a ring engaging said second guide bar to rotate with said second guide bar;

said mechanical linkage including an articulated push rod, said push rod having a respective proximal end coupled to said ring, and said push rod having a distal end coupled to said linear gripper actuating member's proximal end;

a gripper mounted on said gripper receiver, said linear gripper actuating member engaging said gripper to actuate, by its transverse reciprocation, said gripper;

said gripper comprising:

a pivot lever, said pivot lever being operatively connected to said linear gripper actuating member so as to pivot the pivot lever by the transverse reciprocation of said linear gripper actuating member;

a slider crank, said slider crank having a first end operatively connected to said pivot lever; and said slider crank having a second end, said second end being operatively connected to a head of said gripper.

* * * * *